US007195208B2

(12) United States Patent
Caron

(10) Patent No.: US 7,195,208 B2
(45) Date of Patent: Mar. 27, 2007

(54) MULTI-DEVICE CONTROLLER FOR MODEL AIRCRAFT

(76) Inventor: Roger G. Caron, 59 Kimball St., Sanford, ME (US) 04073

( * ) Notice: Subject to any disclaimer, the term of this patent is extended or adjusted under 35 U.S.C. 154(b) by 0 days.

(21) Appl. No.: 11/079,823

(22) Filed: Mar. 14, 2005

(65) Prior Publication Data

US 2006/0214064 A1 Sep. 28, 2006

(51) Int. Cl.
*B64C 13/20* (2006.01)

(52) U.S. Cl. ..... 244/189

(58) Field of Classification Search ..... 244/189, 244/231, 221, 233, 232; 446/36, 59
See application file for complete search history.

(56) References Cited

U.S. PATENT DOCUMENTS 1,533,222 A * 4/1925 Cashman ..... 244/233
2,373,575 A * 4/1945 Lemonier ..... 244/232
3,507,166 A * 4/1970 Nix ..... 74/522
4,316,448 A * 2/1982 Dodge ..... 126/600
4,795,111 A * 1/1989 Moller ..... 244/23 C
4,964,598 A * 10/1990 Berejik et al. ..... 244/190

* cited by examiner

*Primary Examiner*—Tien Dinh
(74) *Attorney, Agent, or Firm*—Patricia M. Mathers; Thomas L. Bohan

(57) ABSTRACT

Control system for radio-controlled aircraft. The control system includes a control master for simultaneously controlling a group of flight control means, for example, a group of ailerons. A control bar is slidably mounted in the control master and connected to a servo-controller. A plurality of controller cables or push rods, one for each flight control means in the group, are connected to the control bar. A sliding movement of the control bar effects a repositioning of the flight-control means.

6 Claims, 2 Drawing Sheets

RX
S
110
D
122
120
126
124
12
12

114
116
108
110
120

10
10A
10B
10C
10D
12C
12D 100
110
108
108
12
120
12
D
111
SA
RX

MULTI-DEVICE CONTROLLER FOR MODEL AIRCRAFT

BACKGROUND INFORMATION

1. Field of the Invention

The invention relates to the field model aircraft. More particularly, the invention relates to controls for ailerons, flaps, and engines for radio-controlled model aircraft.

2. Description of the Prior Art

Flying radio-controlled model aircraft (RC aircraft) is a popular activity. The typical RC aircraft has a variety of flight-control means that include one or more propellers and various control surfaces, such as ailerons, wing flaps, a rudder, and elevators. RC aircraft come in many different designs, weights. Some RC aircraft are equipped with all the flight-control means just mentioned, others have just a propeller and a rudder. Some are well-balanced and relatively easy to fly, others require a great deal of skill in controlling the various flight-control means. To operate the flight-control means, a radio receiver (RX) is generally installed inside the body or the fuselage of the RC aircraft. The operator sends a radio signal to the RX from a corresponding radio transmitter (TX) that has a control panel. The RX converts the signal to a voltage and feeds it to a particular servo-controller, which actuates a mechanical lever or other mechanism to operate a particular flight-control means. For example, after the RC aircraft has been launched into the air, the operator manipulates the controls on the control panel to control the speed of the propeller, raise or lower ailerons, elevators, or wing flaps, or move the rudder to the left or right.

Many of the flight-control means on the RC aircraft are groups of individual control surfaces or engines. If the aircraft is equipped with ailerons, it will have two or Many of the flight-control means on the RC aircraft are groups of individual control surfaces or engines. If the aircraft is equipped with ailerons, it will have two or four of them. It is not unusual for an RC aircraft to have four motor-driven propellers. For purposes of illustration, a flight-control means that comprises multiple control surfaces or multiple engines is referred to hereinafter as a flight-control means group (FCM group) and each individual control surface or engine is referred to as an individual flight-control means (individual FCM). With conventional radio control systems, a servo-motor, referred to simply as servo hereinafter, is provided to each individual FCM in the RC aircraft. Thus, for example, in an RC aircraft with four engines driving the propellers, four servos are provided, each servo connected to a linkage that controls an engine. If the RC aircraft has four ailerons, four additional servos are provided, each one controlling one aileron. A typical RC aircraft has three FCM groups: a first group including four ailerons; a second group including two wing flaps, and a fourth group including four motor-drivin propellers. Thus, it has ten servos to control the ten individual FCMs, rather than three servos to control the three FCM groups. Providing a separate servo for each one of a group of similar FCMs has several disadvantages. For one, a greater number of servos must be installed in the aircraft. This requires space and effort to install the additional devices, as well as the higher acquisition costs. The primary disadvantage, however, is one of aircraft control and safety. The failure of one servo to an individual one of a FCM group inevitably causes the aircraft to become unbalanced, making it difficult, if not impossible, to control and guide the aircraft to a non-catastrophic landing. If a servo to an aileron fails, it is much easier to guide an RC aircraft to a safe landing if all ailerons are in the same position, i.e., the failed position, than if one is stuck in the failed position, while the other three move to the control position.

For the reasons cited above, what is needed is an RC aircraft control system that provides a single control for a FCM group. What is further needed is such a control system that reduces the number of servos required to control the various FCMs and also reduces the cost and effort of installing the FCM.

BRIEF SUMMARY OF THE INVENTION

The invention is a control master comprising a slidably movable control bar powered by a single servo-motor (servo) that together control the position of a group of flight-control means (FCM). The control master is mounted in the fuselage of the RC aircraft, as is the servo and a radio receiver that receives signals broadcast by a radio transmitter operated by the operator of the RC aircraft. The servo is selectively actuated wirelessly via radio signals from the radio receiver.

An FCM is a mechanical device that exerts some control over the flight of the RC aircraft, such as an aileron, a wing flap, an elevator flap, an engine propeller, etc. A "group" of FCMs includes multiples of the same type of FCM. For example, a group of FCMs may consist of four wing flaps, two ailerons, two elevator flaps, or four propeller engines, etc., but not a combination of different types of FCMs.

The servo-controlled control bar is assembled in a control bar guide. Connected to the control bar are actuating means that simultaneously effect a position change of the individual FCMs in the group, as the control bar moves in the control bar guide. A control master is provided for each FCM group. An RC aircraft having four FCM groups that include a first group of four ailerons, a second group of four propellers, a third group of two wing flaps, and a fourth group of two elevator flaps, has four control masters, one for each group. Four mechanical actuating means are attached to the control bar of the first control master, with each actuating means connected to a respective one of the ailerons. The same principle applies to the other control masters for the propellers, the elevator flaps, and the wing flaps. The actuating means for the propellers are connected to engine throttles that drive the propellers. The actuating means are push-pull cables, linkages, or other suitable actuators.

RC aircraft are often transported to flight locations. Because the wing span of the aircraft is usually too wide to allow the aircraft to be easily transported in its fully assembled state, the wings are disassembled for transportation. In order to facilitate the assembly and disassembly of the wings with the RC aircraft control system according to the invention, a splicer for the actuating means is also provided. The actuating means comprises two sections, a first section that is connected to the control bar and a second section that is connected to the FCM to be controlled, with the splicer coupling the two sections. The splicer or quick-coupler allows one section of the actuating means to be quickly and easily decoupled from the other section, which is when the wings have to be disassembled for transportation and storage purposes.

BRIEF DESCRIPTION OF THE DRAWINGS

The present invention is described with reference to the accompanying drawings. In the drawings, like reference numbers indicate identical or functionally similar elements.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art. Furthermore, it is understood that the drawings are not to scale.

Figure 1:
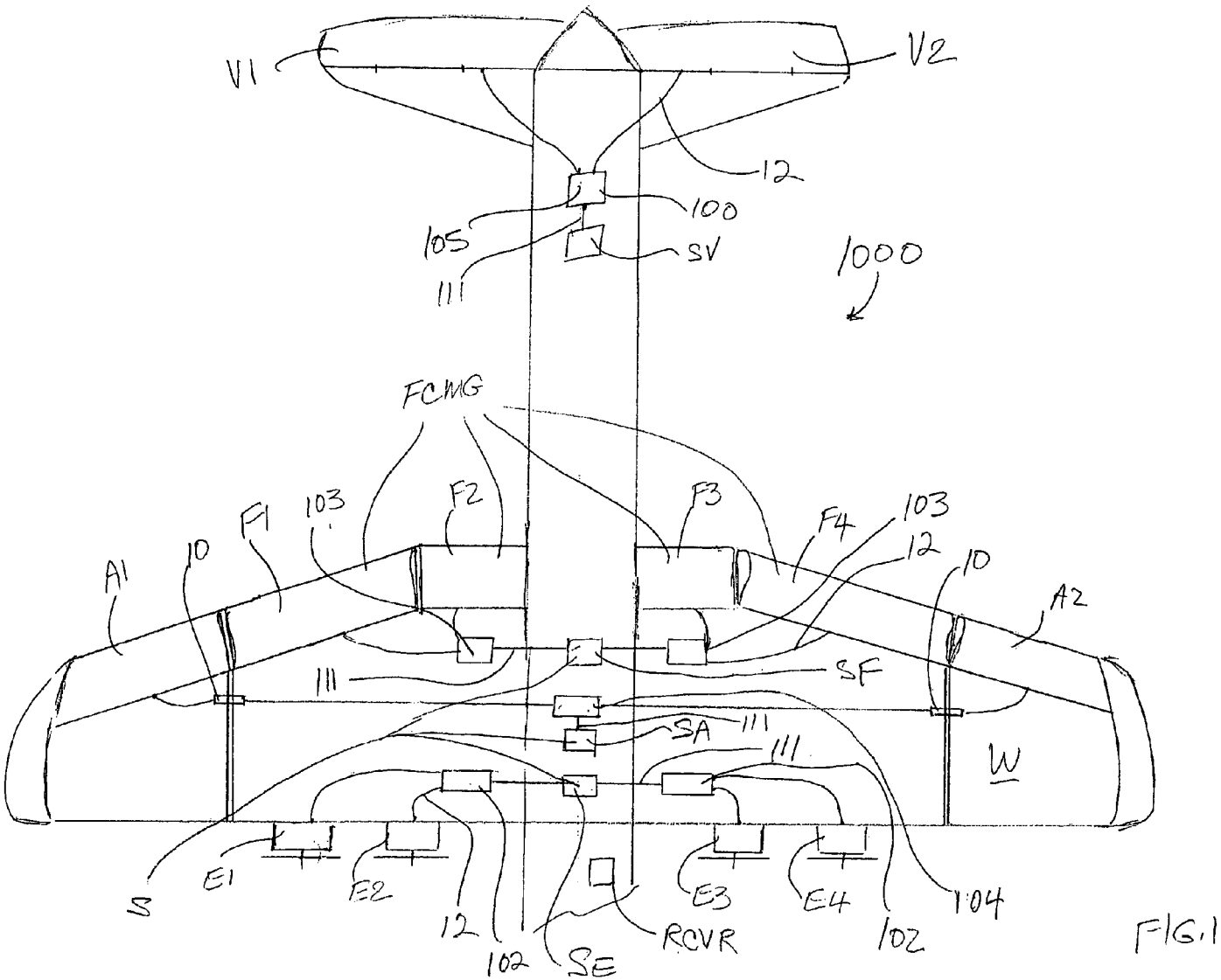
FIG. 1 is a block diagram of an RC aircraft control system according to the invention.

FIG. 1 is a schematic illustration of a RC aircraft control system 1000 for controlling a flight-control means group FCMG on the aircraft. The RC aircraft control system 1000 is assembled in the fuselage of the RC aircraft in the section near the wing root and comprises a radio receiver RX, one servo S for one FCMG, and at least one control master 100 for each servo S. The FCMG is a group of similar flight control means. For example, a first FGMG comprises ailerons A1–A2, a second FCMG comprises wing flaps F1–F4, and a third FCMG comprises engine throttles E1–E4, and a fourth FCMG comprises elevator flaps V1–V2. These FCMGs are representative of various conventional flight-control means and it is understood that the present invention is suitable for controlling the motion of various types of control surfaces and other flight means of an RC aircraft and is not limited to control of FCMs just mentioned. It is also understood that the servos S and the radio receiver RX used in the RC aircraft control system 1000 are conventional, commercially available devices and that the present invention may be used with such devices, irrespective of manufacturer and technical specifications, such as power ratings.

Actuating means 12 are attached to each control master 100. The actuation means 12 shown in this illustration are push-pull controller cables, but push rods or other mechanical linkages that effect a change in position of the flight-control means are included within the scope of this invention. The control master 100 effects a movement of the actuating means 12, which in turn effects a repositioning of the individual FCMs. Several control masters 100 are assembled in the embodiment of the control system 1000 shown in FIG. 1, the various control masters including an engine throttle control master 102, an aileron control master 104, a wing flap control master 103, and an elevator flap control master 105. The engine throttle control master 102 controls the opening of the four engine throttles E1–E4; the aileron control master 104 controls the position of the two ailerons A1–A2; the wing flap control master 103 controls the position of the four wing flaps F1–F2; and the elevator flap control master 105 controls the position of the two elevator flaps V1–V2.

As shown in FIG. 1, one servo S is provided for the one or more control masters 100 that control a particularly FCMG. The servos S shown in FIG. 1 include a throttle servo SE, an aileron servo SA, a wing flap servo SF, and an elevator flap servo SV. A mechanical linkage 111 links each servo with the one or more control masters 100 that control that FCMG. For example, the throttle servo SE is linked to two engine throttle control masters 102. When the throttle servo SE receives radio signal from the receiver RX to open up the throttle, the servo S turns a shaft, causing the control masters 102 to pull the throttle levers of all four engines open. Similarly, when the aileron servo SA receives a signal to open up one or the other of the ailerons A1–A2, it pulls the aileron control master 104 to the appropriate side, causing the one aileron to open and the other to close.

Also shown in FIG. 1 is a splicer or a quick-coupler 10, which allows the actuating means 12 to be quickly and easily coupled and decoupled. This is advantageous, because the wings of the RC aircraft are often disassembled for purposes of transportation and storage and reassembled at the flight location.

Figures 2, 3, 4, 5, 6:
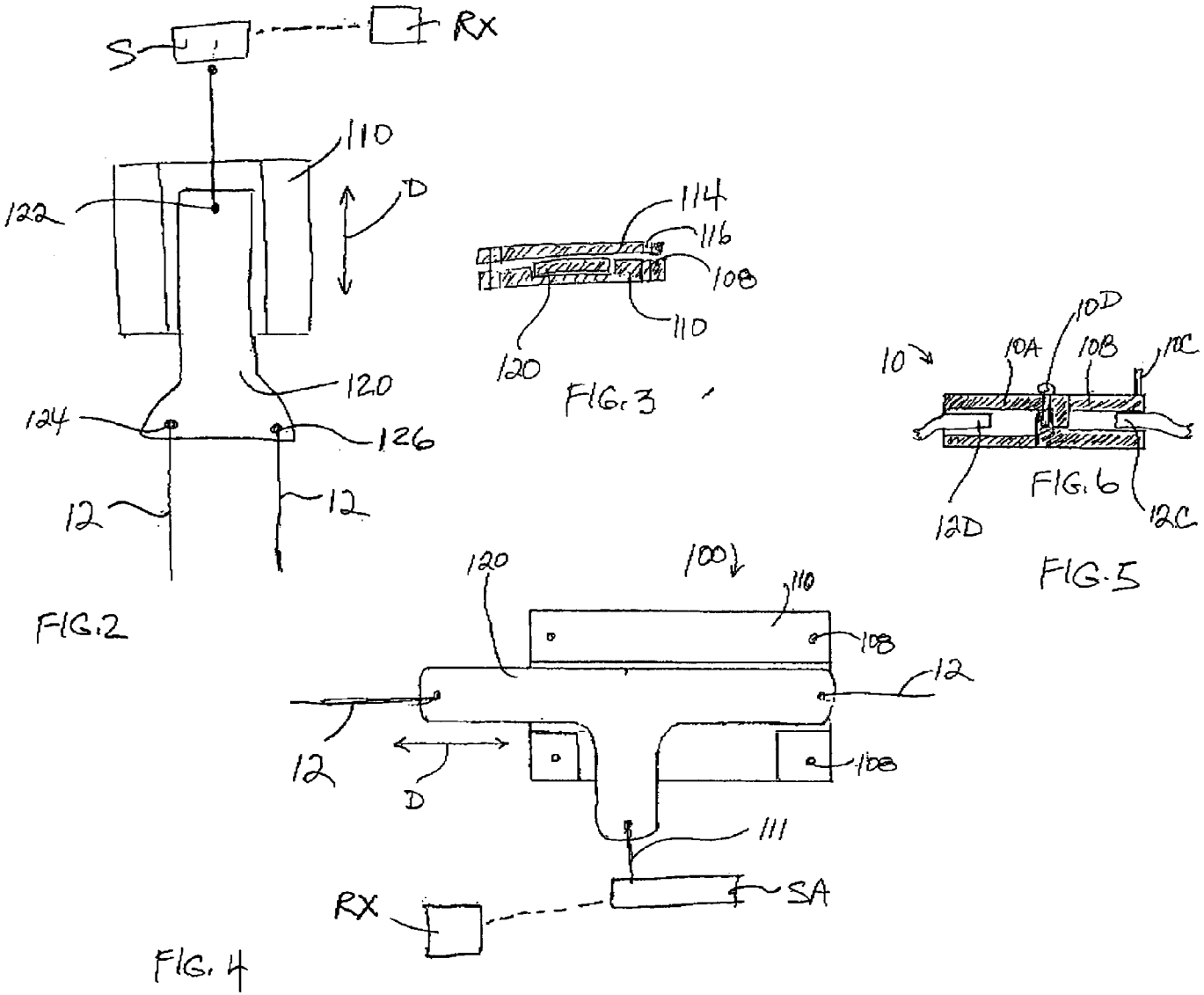
FIG. 2 s a top view of a control master, illustrating a control bar assembled in a control bar guide.
FIG. 3 is a cross-sectional view of the control master with a protective shield.
FIG. 4 illustrates a second shape of the control master according to the invention.
FIG. 5 is a cross-sectional view of a quick-coupler.

FIGS. 2 and 3 illustrate a preferred embodiment of the control master 100, comprising a saddle or control bar guide 110 and a control bar 120. The control bar 120 is slidably assembled in the control bar guide 110. A linkage 111 links the control bar 120 with the servo S. FIG. 3 is a cross-sectional view of the control master 100, showing the control bar guide 110 and the control bar 120. A protective cover 114 may be provided and secured via threaded holes 116, 118 to the control bar guide 110. As indicated by a directional arrow D, the control bar 120 in this particular configuration slides up and down and is well suited to control such FCMs as engine throttles E1–E4. This particular embodiment of the control master 100 is particularly suited for controlling FCMs such as wing flaps, elevator flaps, or engine throttles.

FIG. 4 illustrates a second suitable shape for the control master 100. The control bar 120 slides side to side in the control bar guide 110, as indicated by the directional arrow D. This particular shape is well-suited for controlling the ailerons A1 and A2. When the aileron servo, for example, receives a signal to open an aileron A2, it moves the linkage 111 to the left, causing A1 to open and A2 to close.

FIG. 5 is a cross-sectional view illustrating the splicer or quick-coupler 10 that is used to quickly couple and decouple sections of the actuating means 12. The quick-coupler 10 has a first mating end 10A, a second mating end 10B, a push tab 10C, and a locking device 10D. The actuating means 12 has a first coupler end 12C and a second coupler end 12D, each of which is fixedly attached to a mating end 10A/10B of the quick-coupler 10. The quick-coupler 10 snaps is made of a material with a certain amount of spring force at the mating ends 10A/10B that allow the ends to snap together in an interlocking fit and to unsnap. The locking device 10D, which may be a setscrew or pin or other suitable locking means, prevents the two mating parts of the quick-coupler 12 from inadvertently uncoupling. Other suitable types of quick-couplers may also be used.

Operation of the control system 1000 is as follows: Control signals for the various FCMGs come in to the receiver RX and are directed to the appropriate control master 102, 103, 104, or 105. As the control bar 120 slides in the control bar guide 110, the acuating means 12 simultaneously exert a push or pull on the individual flight-control means of the particular FCM group.

It is understood that the embodiments described herein are merely illustrative of the present invention. Variations in the construction of the control master and the RC aircraft control system may be contemplated by one skilled in the art without limiting the intended scope of the invention herein disclosed and as defined by the following claims.

What is claimed is:

1. Apparatus-for controlling a radio-controlled (RC) aircraft, said apparatus comprising:

two or more control masters for effecting a repositioning of multiple flight-control means within a flight-control-means group;

a servo that is connected to and controls motion of said two or more control masters, thereby effecting a repositioning of said multiple flight-control means; and an actuating means coupling said control masters and said multiple flight control means;

wherein actuation of said servo simultaneously effects a repositioning of said two or more control masters and of all said multiple flight-control means in said flight-control-means group.

2. The apparatus of claim 1, each one of said control masters including a control bar slidably assembled within a control-bar guide and a linkage that links said control bar to said servo, wherein said actuation means couples said control bar and said multiple flight control means, and wherein a displacement of said control bar in said control-bar guide effects said repositioning of said multiple flight-control means.

3. The apparatus of claim 2, further comprising a protective cover that is attachable to said control bar guide.

4. The apparatus of claim 1, wherein said actuating means is a push-pull cable.

5. The apparatus of claim 1, wherein said actuating means is a push rod.

6. The apparatus of claim 2, further comprising a quick-coupler, wherein said actuating means has a first end, a second end, and an intermediate coupling section, said first end being attached to said control bar and said second end attachable to said flight-control means, and wherein said quick-coupler is assembled at said intermediate coupling section, for coupling and decoupling said second end of said actuating means from said first end.

* * * * *